US006139396A

United States Patent [19]

Lin

[11] Patent Number: 6,139,396

[45] Date of Patent: Oct. 31, 2000

[54] TRANSPARENT SPHERICAL TOY

[76] Inventor: Wen-Pin Lin, No. 30, Chien-Yung St., Tung Dist., Taichung City, Taiwan

[21] Appl. No.: 09/478,137

[22] Filed: Jan. 5, 2000

[51] Int. Cl.[7] ..... A63H 23/08

[52] U.S. Cl. ..... 446/267; 40/409

[58] Field of Search ..... 446/269, 267, 446/268, 153, 71–77; 40/406, 407, 409, 411, 410; 273/457, 138.5; 473/594; 285/266; 403/315; 220/4.21–4.25

[56] References Cited

U.S. PATENT DOCUMENTS

| | | | |
|---|---|---|---|
| 1,337,758 | 4/1920 | De Costa | 446/267 |
| 2,351,762 | 6/1944 | Hoover | 446/269 |
| 4,890,838 | 1/1990 | Rudell et al. | 473/594 |
| 5,277,642 | 1/1994 | Dorta | 446/76 |
| 5,351,650 | 10/1994 | Graves | 473/594 |
| 5,893,789 | 4/1999 | Wu | 446/267 |

*Primary Examiner*—Jacob K. Ackun
*Assistant Examiner*—Urszula M. Cegielnik
*Attorney, Agent, or Firm*—Christie, Parker & Hale, LLP

[57] ABSTRACT

A transparent spherical toy includes upper and lower shell halves. The upper shell half has a bottom end face, a thickness reduced rim portion extending downwardly from the bottom end face, an outer recess formed outside of the inner space and extending upwardly from the bottom end face, and a male thread formed on the rim portion. The lower shell half has a top end face, an inner wall, a ring-shaped shoulder projecting into the inner space from the inner wall adjacent to the top end face so that the rim portion is seated against the shoulder, a female thread formed on the inner wall between the top end face and the shoulder and engaging the male thread, and a notch formed in the top end face above the female thread and aligned with the outer recess. The transparent spherical toy further includes a sealing ring disposed between the shoulder and the rim portion for providing sealing therebetween when the male and female threads engage each other tightly, and a dog mounted rotatably in the outer recess and extending therefrom into the notch for preventing the upper shell half from rotating relative to the lower shell half.

8 Claims, 6 Drawing Sheets

TRANSPARENT SPHERICAL TOY

BACKGROUND OF THE INVENTION

1. Field of the Invention

This invention relates to a transparent spherical toy, more particularly to a transparent spherical toy having a fluid stored therein and an ornament floating on the fluid.

2. Description of the Related Art

FIG. 1 illustrates a conventional transparent spherical toy for playing or decorative purpose. The toy includes a transparent spherical shell 1, a fluid 2, such as water, received inside the shell 1, and an ornament 3 that floats on the fluid 2. The shell 1 includes two plastic shell halves which are sealed together via melt welding.

The aforesaid toy has disadvantages in that filth will form and accumulate in the fluid 2 after a period of use, and since the shell 1 is sealed by melt welding, it can not be disassembled to remove the filth, thereby making the toy unattractive. Moreover, the sealing of the shell 1 may be damaged due to a collision, thereby causing the fluid 2 to leak out of the shell 1.

SUMMARY OF THE INVENTION

Therefore, it is an object of the present invention to provide a transparent spherical toy that is capable of overcoming the aforementioned problems.

Accordingly, a transparent spherical toy of this invention comprises: a transparent spherical shell confining therein an inner space which is adapted for receiving a fluid and an ornament that floats on the fluid, the spherical shell having upper and lower shell halves, the upper shell half having a bottom end face, a thickness reduced rim portion extending downwardly from the bottom end face, an outer recess formed outside of the inner space and extending upwardly from the bottom end face, and a male thread formed on the rim portion, the lower shell half having a top end face, an inner wall, a ring-shaped shoulder projecting into the inner space from the inner wall adjacent to the top end face so that the rim portion is seated against the shoulder, a female thread formed on the inner wall between the top end face and the shoulder and engaging the male thread, and a notch formed in the top end face above the female thread and aligned with the outer recess; sealing means disposed between the shoulder and the rim portion for providing sealing therebetween when the male and female threads engage each other tightly; and a dog mounted rotatably in the outer recess and extending therefrom into the notch for preventing the upper shell half from rotating relative to the lower shell half.

BRIEF DESCRIPTION OF THE DRAWINGS

In drawings which illustrate an embodiment of the invention.

DETAILED DESCRIPTION OF THE PREFERRED EMBODIMENT

Figure 1:
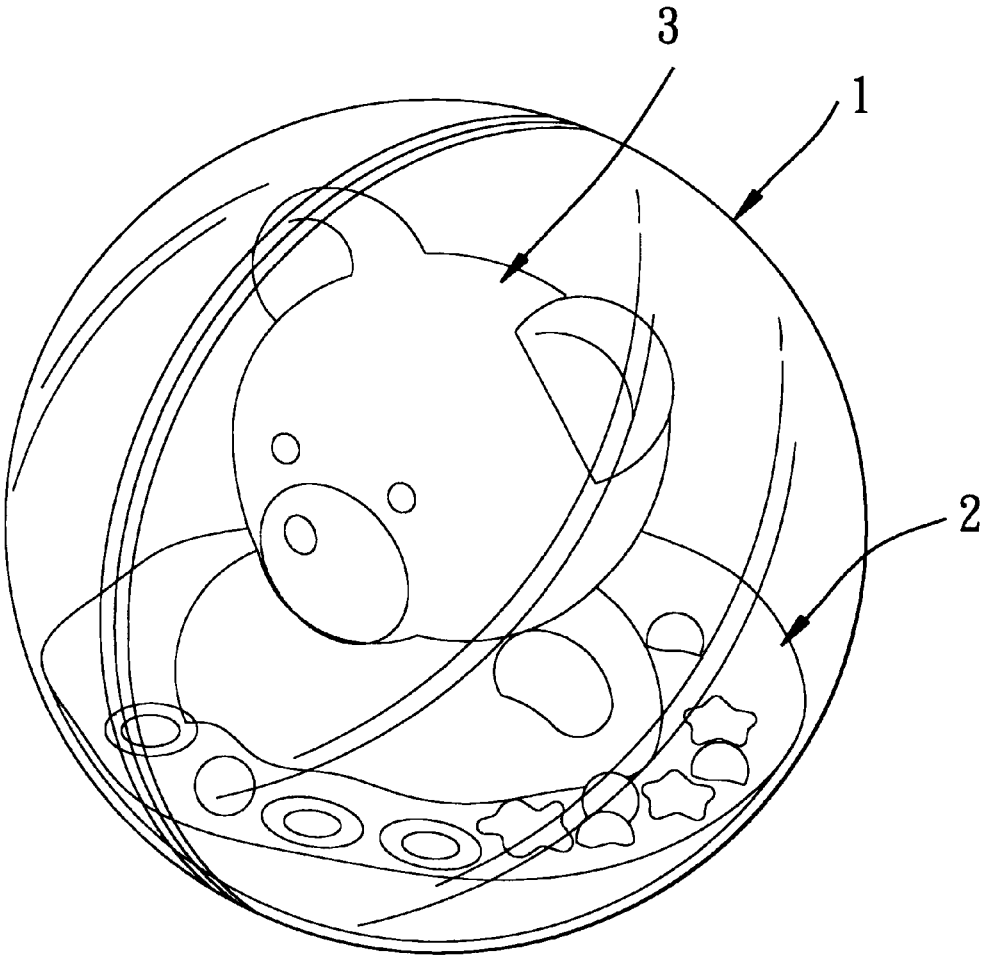
FIG. 1 PRIOR ART
FIG. 1 is a perspective view of a conventional transparent spherical toy.
Figure 2:
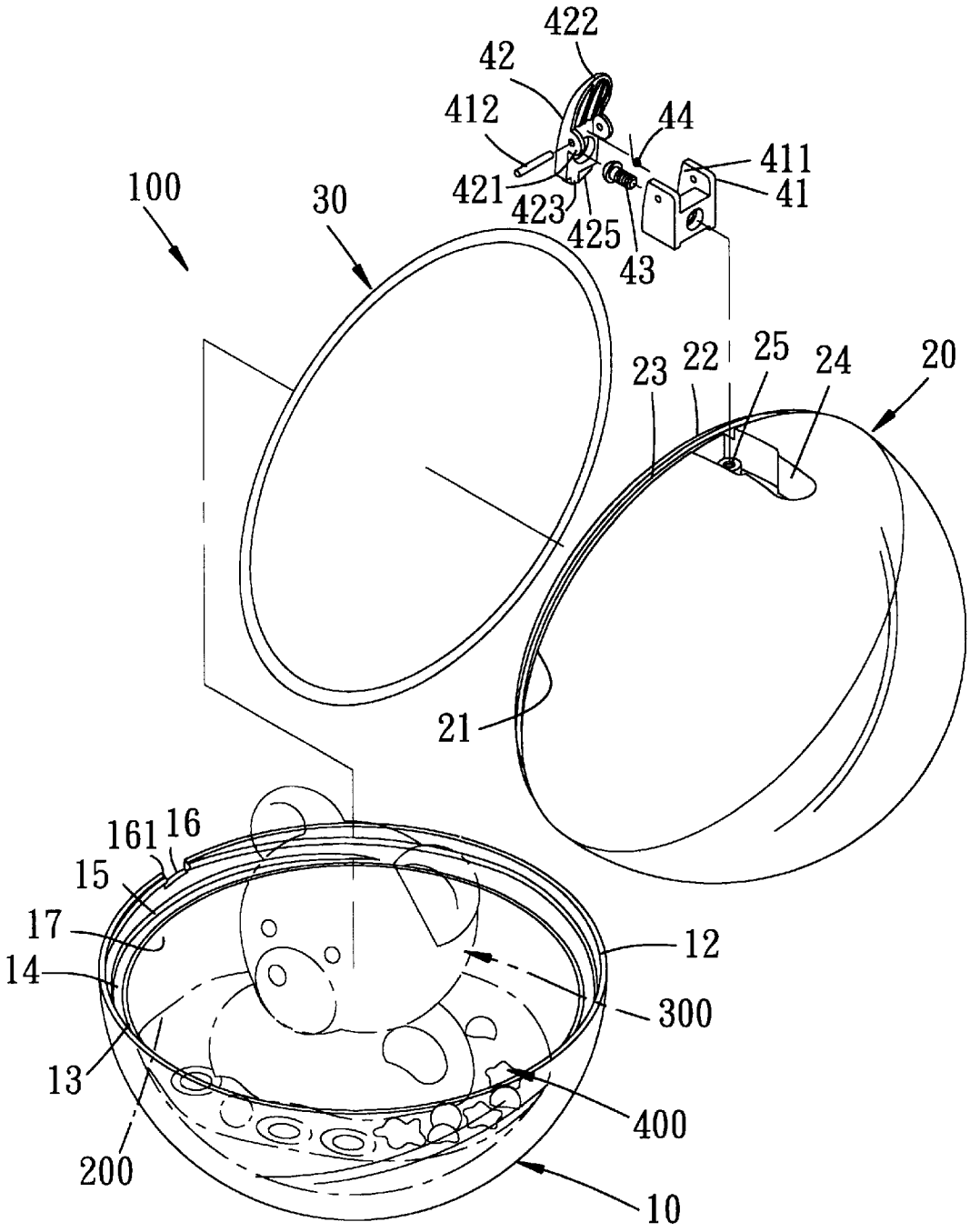
FIG. 2 is an exploded view of a transparent spherical toy embodying this invention.
Figure 3:
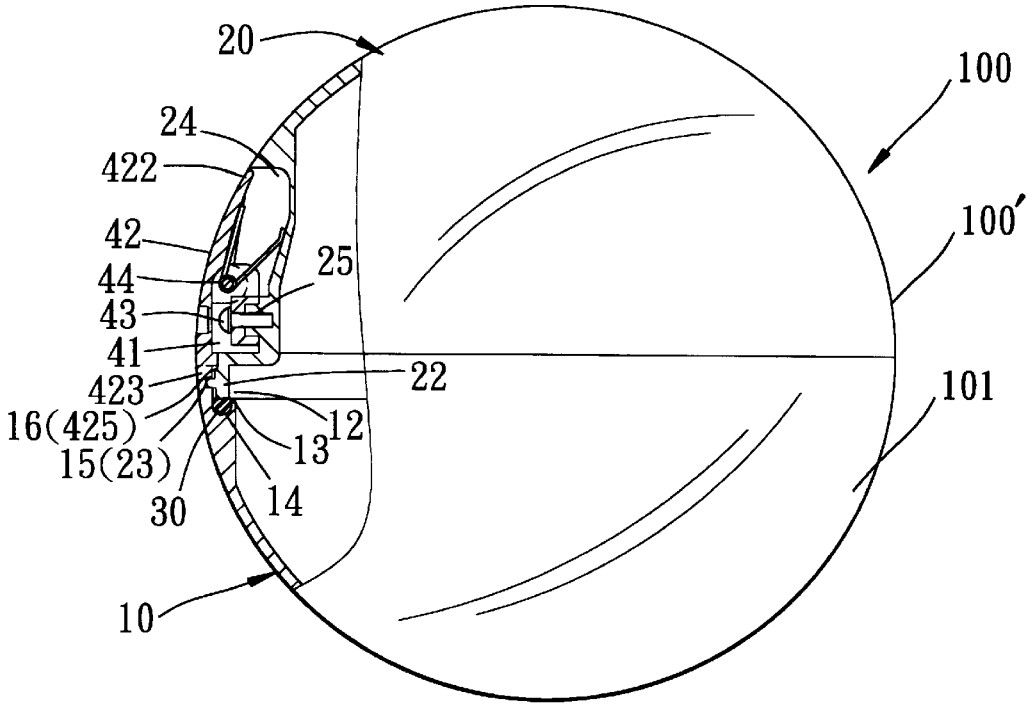
FIG. 3 is a fragmentary cross-sectional side view of the transparent spherical toy of FIG. 2.
Figure 4:
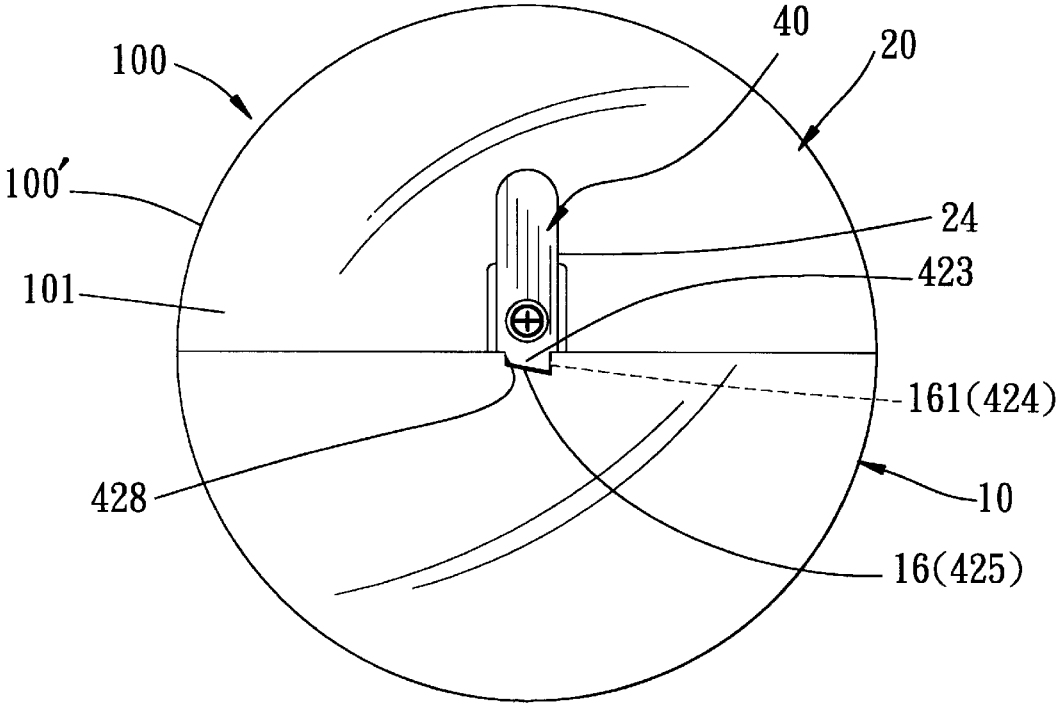
FIG. 4 is a side view of the transparent spherical toy of FIG. 2.

FIGS. 2 to 4 illustrate a transparent spherical toy 100 embodying this invention. The toy 100 includes a transparent spherical shell 100' that is composed of lower and upper shell halves 10, 20, an O-ring 30 acting as sealing means for sealing the lower and upper shell halves 10, 20, and a dog 42 mounted rotatably on the upper shell half 20 and extending to the lower shell half 10 for preventing the upper shell half 20 from rotating relative to the lower shell half 10. The spherical shell 100' confines an inner space 101 that is adapted for storing a fluid 200 and for receiving an ornament 300 which floats on the fluid 200.

The lower shell half 10 has a top end face 12, an inner wall 17, a ring-shaped shoulder 13 projecting into the inner space 101 from the inner wall 17 adjacent to the top end face 12, a female thread 15 formed on the inner wall 17 between the top end face 12 and the shoulder 13, and a notch 16 formed in the top end face 12 above the female thread 15. A ring-shaped inner recess 14 is formed in the shoulder 13 and extends along the length thereof for receiving the O-ring 30 therein.

The upper shell half 20 has a bottom end face 21 that is aligned with and that confronts the top end face 12, a thickness reduced rim portion 22 that extends downwardly from the bottom end face 21 and that is aligned with the inner recess 14 so that the rim portion 22 is seated against the O-ring 30, an outer recess 24 formed outside of the inner space 101 and aligned with the notch 16, and a male thread 23 formed on the rim portion 22 below the bottom end face 21 and engaging the female thread 15 for forming the spherical shell 100'. The outer recess 24 extends upwardly from the bottom end face 21. A hollow cylindrical protrusion 25 projects outwardly from the upper shell half 20 within the outer recess 24. A seat 41 is fastened on the cylindrical protrusion 25 within the outer recess 24 via screw means 43 extending through the seat 41 and the cylindrical protrusion 25. A pair of opposite ears 411 project outwardly of the outer recess 24 from the seat 41.

Figure 5:
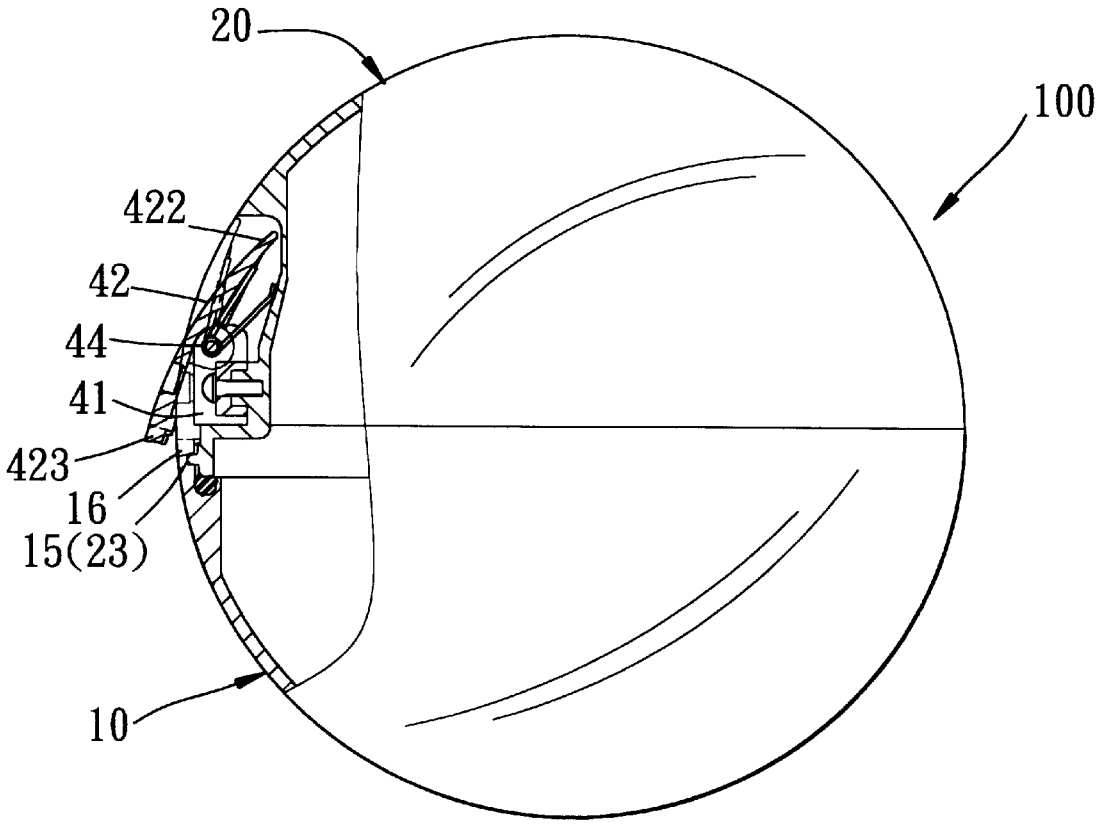
FIG. 5 is a fragmentary cross-sectional side view of the transparent spherical toy of FIG. 2, illustrating with a dog thereof in a releasing state.

The dog 42 includes an upper press portion 422 that is embedded in the outer recess 24, a lower extension 423 that extends downwardly from the upper press portion 422 and into the notch 16 for preventing the upper shell half 20 from rotating relative to the lower shell half 10, and a pair of opposite ears 421 which project therefrom between the upper press portion 422 and the lower extension 423. The dog 42 is mounted pivotally on the seat 41 via a pin 412 extending through the ears 421 of the dog 42 and the ears 411 of the seat 41 so that the dog 42 is rotatable relative the seat 41. The dog 42 further includes a torsion spring 44 that is sleeved around the pin 412 between the opposite ears 421 of the dog 42 so as to urge the upper press portion 422 and to move the lower extension 423 into the notch 16. The lower extension 423 is moved out of the notch 16 when the upper press portion 422 is pressed against the torsion spring 44 (see FIG. 5). The spherical shell 100' can be disassembled by rotating the upper shell half 20 relative to the lower shell half 10 with the upper press portion 422 in a pressed state.

Figure 6:
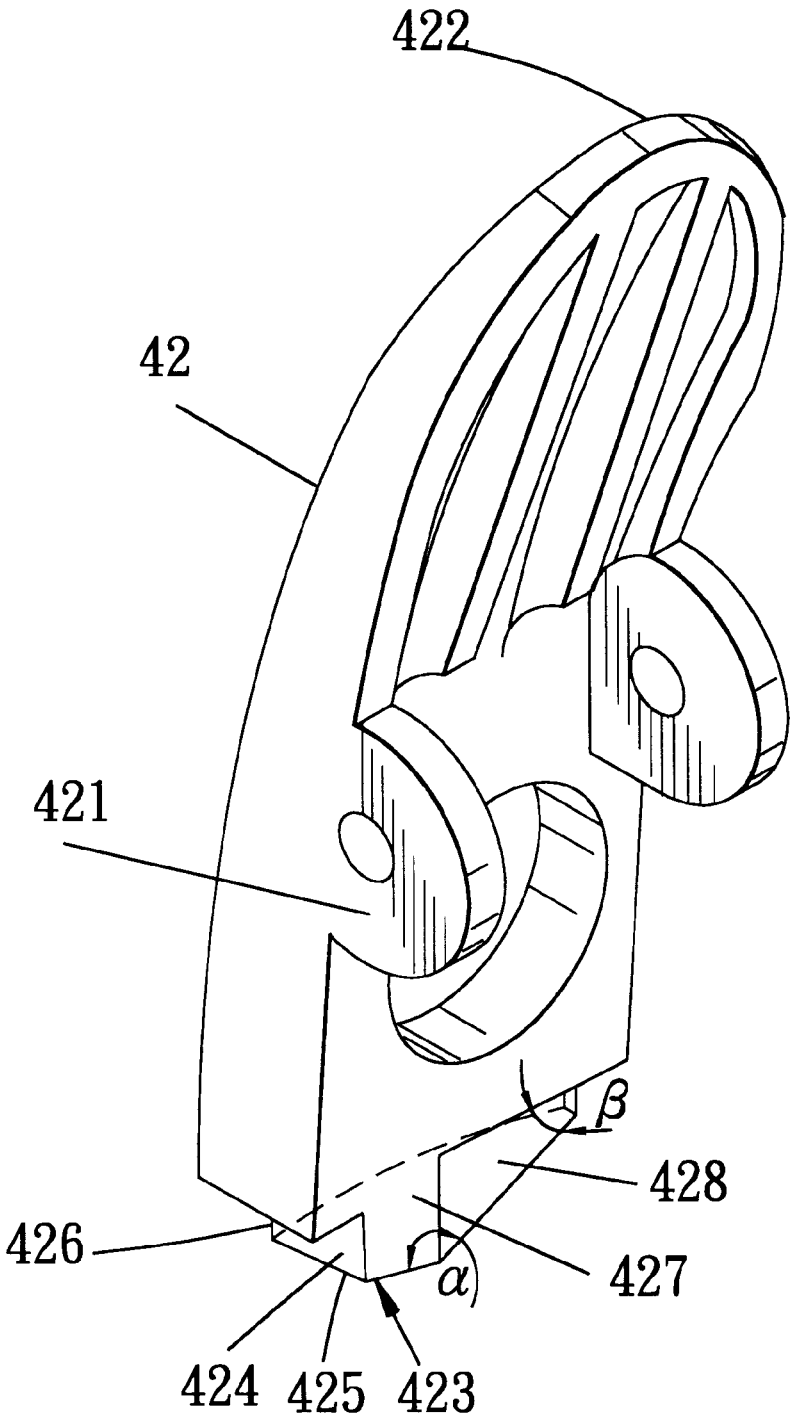
FIG. 6 is a perspective view of a dog of the transparent spherical toy of FIG. 2.

Referring now to FIG. 6, in combination with FIGS. 2 to 4, the lower extension 423 has radially opposite outer and inner faces 426, 427, circumferentially opposite left and right side faces 428, 424 interconnecting side edges of the outer and inner faces 426, 427, and a wedge-shaped bottom face 425 which interconnects side edges of the outer and inner faces 26, 27 and side edges of the left and right side faces 28, 24. The bottom face 425 inclines upwardly from the outer face 426 to the inner face 427 and inclines downwardly from the left side face 428 to the right side face 424. The left side face 428 of the lower extension 42 is inclined relative to the outer face 426 with an acute angle β, and is inclined relative to the inner face 427 with an oblique angle α. The right side face 424 of the lower extension 42 is preferably an inclined face that inclines toward the left side face 428 of the lower extension 42. The notch 16 has a side face 161 in a circumferential direction that matches and confronts the right side face 424 of the lower extension 42 so that the lower extension 42 can be firmly retained in the notch 16. The design of the lower extension 42 permits a smooth mating operation of the lower and upper shell halves 10, 20 during assembly of the spherical shell 100'.

Figure 7:
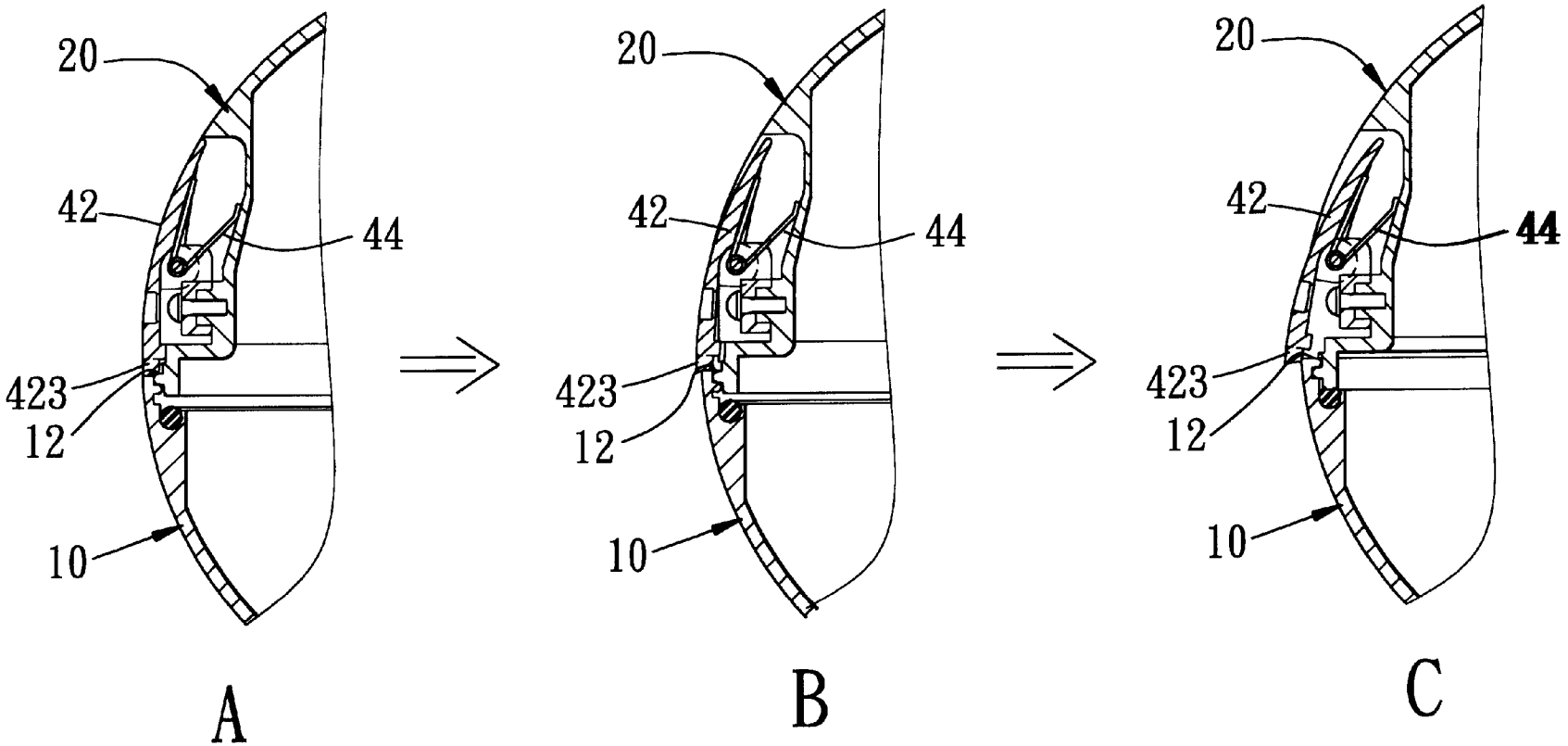
FIG. 7 is a fragmentary cross-sectional side view of the transparent spherical toy of FIG. 2 with a dog in a progress that moves outwardly therefrom.

FIG. 7 illustrates how the lower extension 23 moves away from the top end face 12 upon rotating the upper shell half 20 relative to the lower shell half 10 from A to C during assembly of the spherical shell 100'. With further reference to FIG. 3, in the beginning, the lower extension 23 is aligned above the top end face 12 and approaches the top end face 12 during assembly. As the lower extension 23 contacts the top end face 12, it cannot move forward if the bottom end face 425 is not designed as an inclined face as described above. The bottom end face 425 of this invention is able to produce a pushing force acting on the lower extension 423 for moving the lower extension 423 away from the top end face 12 and for pressing the upper press portion 422 against the torsion spring 44 when the lower extension 423 is brought into contact with the top end face 12 during assembly. As soon as the lower extension 423 is aligned with the notch 16, the former is then urged and moved into the latter by the torsion spring 44.

With the invention thus explained, it is apparent that various modifications and variations can be made without departing from the spirit of the present invention. It is therefore intended that the invention be limited only as recited in the appended claims.

I claim:

1. A transparent spherical toy, comprising:

a transparent spherical shell confining therein an inner space which is adapted for receiving a fluid and an ornament that floats on the fluid, said spherical shell having upper and lower shell halves, said upper shell half having a bottom end face, a thickness reduced rim portion extending downwardly from said bottom end face, an outer recess formed outside of said inner space and extending upwardly from said bottom end face, and a male thread formed on said rim portion, said lower shell half having a top end face, an inner wall, a ring-shaped shoulder projecting into said inner space from said inner wall adjacent to said top end face so that said rim portion is seated against said shoulder, a female thread formed on said inner wall between said top end face and said shoulder and engaging said male thread, and a notch formed in said top end face above said female thread and aligned with said outer recess;

sealing means disposed between said shoulder and said rim portion for providing sealing therebetween when said male and female threads engage each other tightly; and a dog mounted rotatably in said outer recess and extending therefrom into said notch for preventing said upper shell half from rotating relative to said lower shell half.

2. The transparent spherical toy of claim 1, wherein said shoulder has a ring-shaped inner recess extending along the length thereof and disposed, below said rim portion, said sealing means being an O-ring which is received in said inner recess.

3. The transparent spherical toy of claim 1, further comprising a seat which is fastened on said upper shell half in said outer recess, said dog being mounted pivotally on said seat and having an upper press portion that is embedded in said outer recess, a lower extension that extends downwardly from said upper press portion and into said notch for preventing said upper shell half from rotating relative to said lower shell half, a pair of opposite ears which project therefrom between said upper press portion and said lower extension and which are mounted pivotally on said seat, and a biasing spring to urge said upper press portion so as to move said lower extension into said notch, said lower extension being releasable from said notch when said upper press portion is pressed against said biasing spring.

4. The transparent spherical toy of claim 3, wherein said dog is mounted pivotally on said seat via a pin extending through said opposite ears and said seat, said biasing spring including a torsion spring sleeved around said pin.

5. The transparent spherical toy of claim 4, wherein said lower extension has opposite outer and inner faces, opposite inclined side faces which converge from said outer face toward said inner face, and a wedge-shaped bottom face which inclines upwardly from said outer face toward said inner face and which inclines downwardly from one of said opposite side faces to the other one of said opposite side faces.

6. The transparent spherical toy of claim 5, wherein said notch has two opposite side faces, one of said opposite side faces of said notch matching said one of said opposite side faces of said lower extension.

7. The transparent spherical toy of claim 4, wherein said lower extension has opposite outer and inner faces, side faces which are opposite to each other in a circumferential direction, and a wedge-shaped bottom face connected to bottom ends of said outer and inner faces and said side faces, one of said side faces being inclined relative to said inner face with an oblique angle and relative to said outer face with an acute angle.

8. The transparent spherical toy of claim 7, wherein said bottom face inclines upwardly from said outer face toward said inner face and inclines downwardly from one of said opposite side faces to the other one of said opposite side faces.

* * * * *